United States Patent [19]

Wynnyk

[11] 4,050,468

[45] Sept. 27, 1977

[54] REUSABLE POCKET ASH RECEPTACLE

[76] Inventor: Eugene E. Wynnyk, 17 Berlin St., Binghamton, N.Y. 13905

[21] Appl. No.: 736,399

[22] Filed: Oct. 28, 1976

Related U.S. Application Data

[63] Continuation-in-part of Ser. No. 589,797, June 24, 1975, abandoned.

[51] Int. Cl.[2] ..... A24B 5/02

[52] U.S. Cl. ..... 131/232; 131/241; 150/10

[58] Field of Search ..... 131/232, 241, 231; 150/5, 10, 3, 37, 48, 51

[56] References Cited

U.S. PATENT DOCUMENTS

| | | | |
|---|---|---|---|
| 1,190,935 | 7/1916 | Minor | 150/10 |
| 1,310,869 | 7/1919 | McHugh | 150/10 X |
| 3,349,778 | 10/1967 | Jablonski | 131/241 |

FOREIGN PATENT DOCUMENTS

| | | | |
|---|---|---|---|
| 20,067 | 5/1905 | Germany | 150/10 |
| 437,171 | 11/1926 | Germany | 150/10 |

*Primary Examiner*—Stephen C. Pellegrino
*Attorney, Agent, or Firm*—Frederick E. Bartholy

[57] ABSTRACT

A pocket ash receptacle of U-shaped configuration comprises a flat pouch of flexible material adapted to be opened by compressing the edges thereof. A reinforcing resilient metallic wire frame insert, shaped to follow the edge configuration, is located within the pouch. Upon opening of the pouch by exerting lateral pressure, a portion of the insert forms a solid body across the mouth of the pouch over which the end of a cigarette may be passed for removal of the ash or against which the burning end may be snuffed out. In one modification, the solid body of the insert across the mouth of the pouch has such configuration as to permit the cleaning of the bowl of a pipe.

1 Claim, 4 Drawing Figures

REUSABLE POCKET ASH RECEPTACLE

This is a continuation-in-part of my pending application, Ser. No. 589,797 filed June 24, 1975, now abandoned.

This invention relates to portable devices to be carried by smokers for receiving the ashes from cigarettes, cigars, or pipes.

At the present time, smokers often find themselves in an embarassing situation, inasmuch as, due to the general decline of the smoking habit, ash trays are not readily available. Moreover, in view of environmental awareness, in certain group activities in public places, smokers find it difficult to dispose of the by-products of their enjoyment.

In the past, attempts have been made to provide portable ash receivers in various forms.

The earliest references to a reusable type are found in U.S. Pat. No. 820,067 dated May 8, 1906 and U.S. Pat. No. 2,432,656 dated Dec. 16, 1947.

Others of the disposable type are shown in U. S. Pat. No. 2,636,532 dated Apr. 28, 1953 and U.S. Pat. No. 2,990,100 dated June 27, 1961.

The prior patents listed above are of interest solely in that their objective is akin to that of the present invention. However, as will be seen from the description which follows, they are lacking in many of the novel and important features.

Mention should be made here that pouch type receptacles which are generally flat and may be opened by lateral pressure have been known to serve diverse purposes, such as tobacco pouches or holders for cigarettes. In this connection, the following patents are of interest: U.S. Pat. No. 1,310,869 dated July 22, 1919; U.S. Pat. No. 1,190,935 dated July 11, 1916; German Pat. No. 437,171 dated Nov. 16, 1926; and Austrian Pat. No. 20,067 dated May 10, 1905. These all contain wire frames of one type or another so as to maintain the pouch flat when not in use and expand to form an opening upon lateral pressure.

Accordingly, it is the primary object of the invention to provide a pouch-type receptacle to be carried about by the individual for the disposal of ashes and also for extinguishing cigarettes or cigars.

It is a particular feature of the invention that the device in accordance therewith has extended utility in that it permits the removal of the contents from the bowl of a pipe.

It is a particular advantage of the invention that the ash receptacle in accordance therewith may be carried unobtrusively in the pocket of the individual and may be used repeatedly.

Other objects, features and advantages will be apparent from the following description of the invention, pointed out in particularity in the appended claims, and taken in connection with the accompanying drawing in which:

Figure 1:
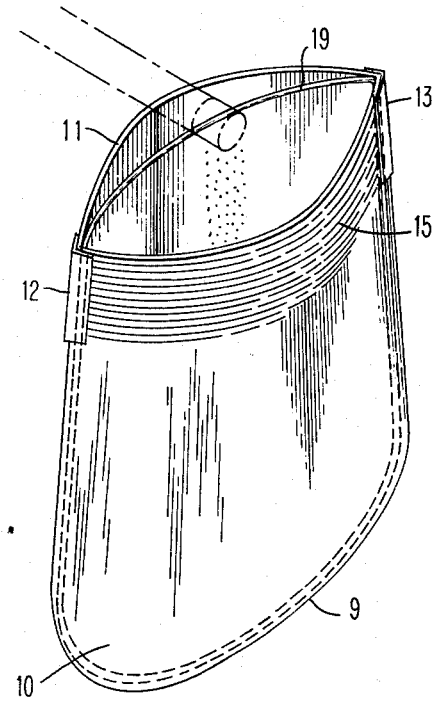
FIG. 1 is a perspective view of the receptacle in open condition ready to receive the ashes from a cigarette.

Referring to the figures, in FIG. 1 it is seen that the receptacle comprises a pouch 9 of U-shaped configuration having a front side 10 and a rear side 11. The sides are arbitrarily chosen as front or rear, since these are both alike. The sides are superimposed, one upon the other, and fastened together at the edges in various ways, such as gluing or sewing, depending upon the material used. For flexibility and economy of manufacture, plastic materials available in different types may be used, for example, nylon is an ideal material. Real or artificial leather may serve the purpose as well. The important consideration is that the material be durable and flexible.

Clamps 12 and 13 of brass or other metal affixed to the top serve to strengthen the upper portion where the user exerts compressive force by his fingers in order to open the pouch, as seen in FIG. 1.

A band 15 affixed to the sides 10 and 11 may be of gold braid and serves only a decorative purpose.

Figure 3:
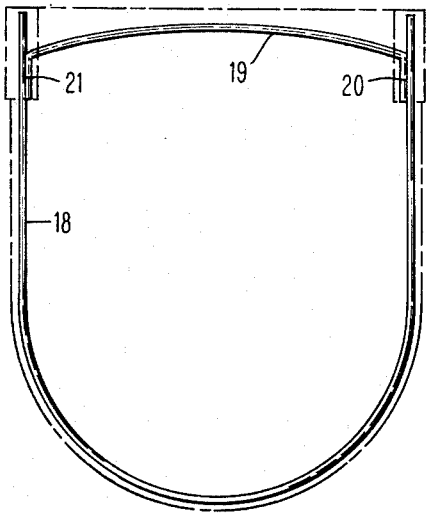
FIG. 3 is a plan view with one side removed showing the type of insert utilized in the embodiment of FIG. 1.
Figure 4:
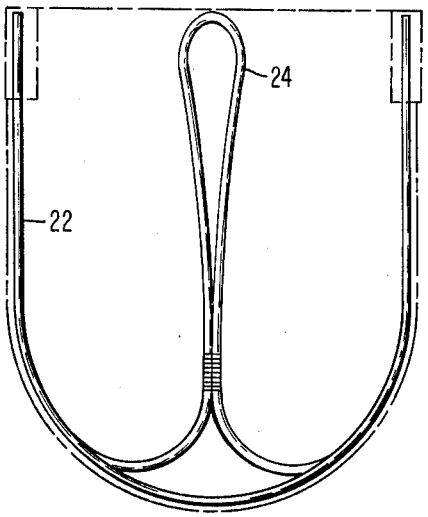
FIG. 4 is a plan view similar to that of FIG. 3 showing the type of insert utilized in FIG. 2.

Within the pouch is placed a resilient wire frame 18, as seen in FIG. 3, which serves as a reinforcing and closing means. It tends to exert lateral pressure to maintain the sides 10 and 11 of the pouch in a substantially flattened condition with the open end closed. However, the important feature of the invention is that the frame 18 has a transverse wire portion 19 which may be welded to it at 20 and 21. The portion 19 is parallel to the sides 10 and 11, thus runs across the mouth of the pouch. As seen in FIG. 1, when the pouch is opened by lateral pressure, it serves as a solid body against which the end of a cigarette (shown in phantom lines) may be passed.

Figure 2:
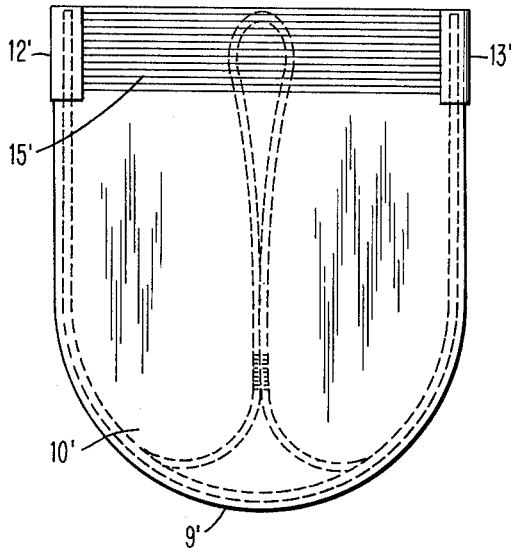
FIG. 2 is a plan view with a particular frame insert shown in dotted lines.

The pocket ash receptacle shown in FIG. 2 is identical in construction with that of FIG. 1. Consequently, its components bear the same reference characters except for primary indices. However, the reinforcing insert frame 22 is of different construction than the frame 18 shown in FIG. 3.

The frame 22 forms a loop 24 located centrally of the pouch 9' and extends vertically from the bottom thereof. The frame 22 is also of U-shaped configuration and, by virtue of its resiliency, exerts an expanding force at the edges of the pouch 9'. In this manner, the latter is maintained in a flattened condition until pressure is exerted at the edges, thus compressing the frame 22.

The loop 24 serves the same purpose as the bar 19 shown in FIG. 1. However, by virtue of its configuration, it is also useful for pipe smokers inasmuch as the bowl, placed thereon, can be scraped of all ashes which are thus deposited into the pouch.

The construction of the reusable pocket ash receptacle hereinabove described is extremely simple and may be made of various flexible materials, as for example nylon, plastic, or leather. The sides 10 and 11 may be sewn or glued together to form a solid receptacle.

It is to be understood that a fire-resistant material would be used to line the receptacle. This is not shown in the drawings in order to simplify the illustration. Material of this type may be a thin layer of asbestos. In practice, use has been made of crocus cloth marketed under the tradename "FLEXBAC" by Carborundum Corporation.

The invention in its broader aspects is not limited to the specific embodiments herein shown and described but changes may be made within the scope of the accompanying claims without departing from the principles of the invention and without sacrificing its chief advantages.

What is claimed is:

1. A pocket ash receptacle for receipt of ashes from smoking materials, said receptacle comprising:

a generally U-shaped pouch of flexible material, said pouch having a front side and a rear side, said front and rear sides being joined at their edge portions along the periphery of said U to provide said pouch with an openable mouth portion;

a resilient, U-shaped wire frame corresponding to the U-shape of said pouch, said frame being secured within the edge portions of said pouch and exerting outward pressure against said periphery of said pouch to maintain said mouth portion closed; and a transverse wire loop member secured to lower leg portions of said U-shaped wire frame and extending upwardly therebetween, an upper portion of said loop member being of a size to fit within the bowl of a pipe, at least a portion of said transverse wire loop member extending within said pouch adjacent a portion of said mouth of said pouch centrally between said front and rear sides of said pouch when said legs of said resilient wire frame are moved toward each other to open said mouth of said pouch, whereby said transverse wire loop member is disposed centrally in said mouth of said pouch to facilitate ash removal from said smoking material placed in contact with said transverse wire loop member, said ashes so removed being collected in said pouch.

* * * * *